United States Patent [19]

Rosenbaum et al.

[11] Patent Number: 4,517,753

[45] Date of Patent: May 21, 1985

[54] SHOE

[76] Inventors: Leslie Rosenbaum, Jungfrudansen 44, Solna, Sweden, 171 56; Robert Alberts, Gummarpsvägen 27, Helsingborg, Sweden, 254 84

[21] Appl. No.: 375,033

[22] PCT Filed: Aug. 18, 1981

[86] PCT No.: PCT/SE81/00231

§ 371 Date: Apr. 15, 1982

§ 102(e) Date: Apr. 15, 1982

[87] PCT Pub. No.: WO82/00573

PCT Pub. Date: Mar. 4, 1982

[30] Foreign Application Priority Data

Aug. 18, 1980 [SE] Sweden ..... 8005898

[51] Int. Cl.[3] ..... A43B 5/02

[52] U.S. Cl. ..... 36/128; 36/50; 36/54

[58] Field of Search ..... 36/128, 114, 54, 55, 36/106, 110, 129

[56] References Cited

U.S. PATENT DOCUMENTS

| | | | |
|---|---|---|---|
| 1,542,848 | 6/1925 | Barnes | 36/54 |
| 1,809,998 | 6/1931 | Wernmark . | |
| 2,088,851 | 8/1937 | Gatenbein | 36/50 |
| 2,210,430 | 8/1940 | Post | 36/54 |
| 2,241,653 | 5/1941 | Weyenberg | 36/54 |
| 4,255,876 | 3/1981 | Johnson | 36/50 |

FOREIGN PATENT DOCUMENTS

| | | | |
|---|---|---|---|
| 1685224 | 4/1971 | Fed. Rep. of Germany . | |
| 1520286 | 2/1968 | France | 36/54 |
| 358787 | 4/1938 | Italy | 36/128 |

*Primary Examiner*—Werner H. Schroeder
*Assistant Examiner*—Tracy Graveline
*Attorney, Agent, or Firm*—Kane, Dalsimer, Kane, Sullivan & Kurucz

[57] ABSTRACT

A shoe particularly a sportshoe, has a side lacing (1) with a slit (2) extending from an edge (4) of a foot opening (3) toward a toe area at the outside of the shoe over a part of the upper (5) of the shoe, and a tongue (10) covering from below the side lacing, said tongue being according to the invention fastened to the upper with a stitching (11) located within an area extending substantially about a central line (6) at a distance from and along said slit (2), and extending, as seen in the longitudinal direction of the shoe, from the forward end (12) of said slit toward the foot opening (3) over a distance of least one third of the slit's length.

5 Claims, 2 Drawing Figures

SHOE

Figure 1:
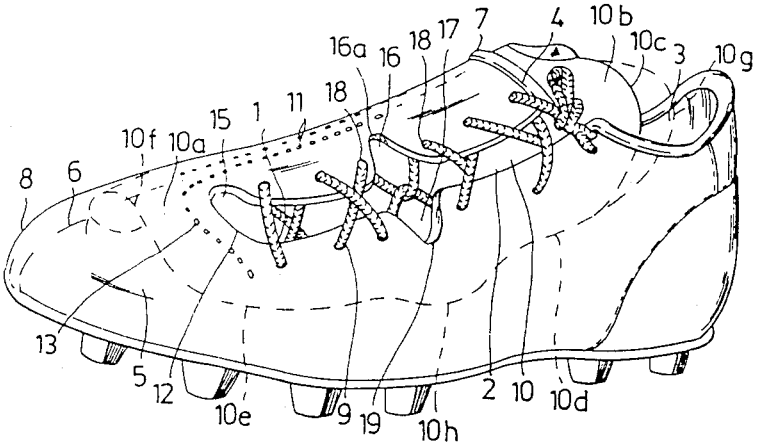

This invention relates to shoes, particularly shoes where considerable strain is placed on the foot.

Previous development of sport shoes have aimed at producing shoes with good fit and a high degree of comfort, suited for these purposes in varying ways. However, in which respect an invention actually improved fit and comfort has not always been made clear. This invention considers three key problems central to any good shoe design. For sport shoes or other types of shoes, these problems are: stability, flexibility, and fit. A "comfortable" sport shoe must possess a sufficient amount of all three characteristics.

Stability of the shoe contributes to keeping the foot in the correct position. That is, the bones, tendons, and ligaments are kept in the correct position to each other regardless of the degree and kind of foot movement. The desirable degree of stability is to a large extent dependent on the sport for which the shoe is intended.

Flexbility is desirable since the foot should conform in innumerable, different, and anatomically acceptable ways so as to bend naturally where required, if it is to be experienced by the user as being comfortable.

Generally, stability and flexibility are characteristics which oppose each other; the more of one the less of the other.

One aim of this invention is to significantly counter the viewpoint that stability and flexibility are opposites, and that more of one necessarily means less of the other.

The fit of the shoe is the remaining key factor, if a high degree of stability and flexibility has been achieved. With shoes according to this invention, the degree of fit achieved actually depends on the same means used for achieving high degree of stability and high degree of flexibility.

For this purpose, a shoe, particularly a sport shoe, having side laces extending substantially in the longitudinal direction of the shoe and placed on the outside as seen from a longitudinal central line running from the shoe's forward edge of the foot opening to the front of the shoe, and a tongue lying under the lace and extending to cover from above a user's foot, has characteristics according to one or several of the appending claims.

Shoes according to the claims have, in testing, shown substantial improvements, compared with previously known sport shoes. These improvements are particularly noticeable with regard to how the shoe forms to the foot in many ways, giving the foot stability even after long use, as well as absence of problems often arising in combination with tongue and laces.

Shoes with a tongue covering a major part of the foot's upper side are previously known (U.S. Pat. No. 3,768,182) in the sense that such shoes simulate a smooth and soft inner shoe. However, such shoes is reality have not fulfilled expectations, in that the problem of tongue movement in the transverse and longitudinal directions has caused inconvenience due to wrinkling or other undesirable deformations of the tongue. Prior art regards these deformations as a serious and important problem (U.S. Pat. No. 3,299,542), but before the appearance of the present invention there has been no really satisfactory solution, even if, on the other hand, tongue movement in modern sport shoes with relatively small tongues has not been a real problem. But when a tongue is made large to cover major parts of the upper and side of the foot, then tongue slippage is a serious problem, as is wrinkling.

Fastening the tongue according to the invention solves the problem of tongue slippage and deformation by very simple means, thereby achieving the important benefits of large tongues, namely to cover the foot and simulate an inner shoe, and simultaneously providing high stability and good fit.

Fastening the tongue according to this invention inherently requires side laces, which is known per se (FR-PS No. 2000 667, SE-PS No. 88252) and by which the pressure on the foot of a normal central lace, acting from above on the middle of the foot, a pressure sensitive area, is replaced by a relatively even pressure of a smooth upper.

Even if fastening the tongue according to this invention, in combination with side laces, makes possible good stability, flexibility, and fit, and this for essentially all foot shapes, nevertheless flexibility may be unsatisfactory for shoes of certain purposes. Specifically, the shoe may be too stiff when the foot must be able to adopt the most varying positions. Therefore, it may be necessary or an advantage when using the way of fastening the tongue, according to the invention, to have a number of V-shaped recesses along the lace slit in a way that will be described in the following.

Figure 2:
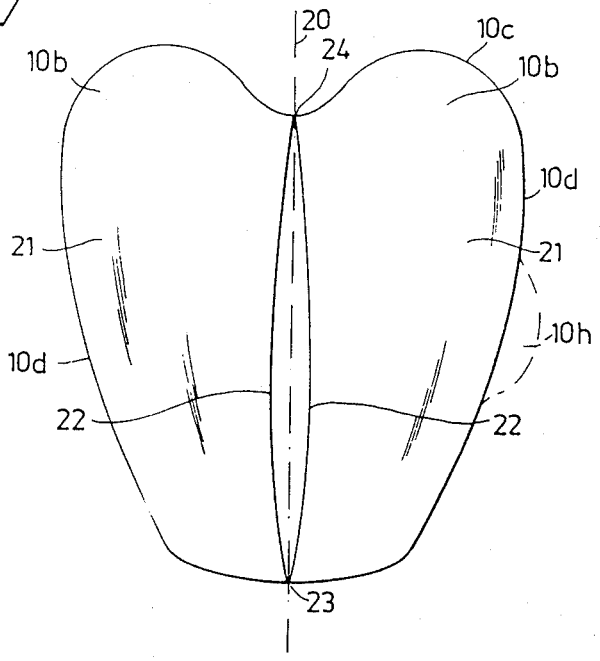

In the following the invention is illustrated in detail, reference being made to the enclosed drawing in which:

FIG. 1 shows a soccer shoe according to the invention seen in perspective, and FIG. 2 illustrates a design for a tongue according to FIG. 1.

The shoe illustrated by FIG. 1 has a side lace 1 running in the longitudinal direction of the shoe around a slit 2 from the edge of the foot opening 3, angled forward on the outside of the shoe over part of the upper 5 towards the toe area. As preferred, the lace slit 2 extends between half and three quarters of the distance between the front edge 4 of the foot opening 3 and the forward edge of the upper 5 toe area, at the outside of a line 6 from the forward highest position 7 of the foot opening to the forward edge 8 of the area, said line hereinafter called the central line of the shoe.

According to this invention the tongue 10 is fastened to the upper with one or several seams, or stitchings, within an area that extends centrally in the longitudinal direction of the shoe from the forward end 12 of the slit 2 in the direction toward the forward part of the foot opening 4, that is, in the longitudinal direction of the shoe in or close to said central line.

This stitching consists preferably of one or several continuous seams, which, however, do not extend all way up to the foot opening 4, but over a distance of between one-third and two-thirds of the distance between slit end 12 and foot opening 4. This fastening of the tongue to the upper can be done with the same effect by means of a number of pointwise arranged or transversely extending stitches distributed over said area. As shown on the drawing, two longitudinally placed and parallel seams, or stitches, 11 are placed at equal distances from the central line on the upper. These seams should not be placed at a larger distance from the central line than 0.75 cm up to 1 cm, otherwise the ability of the tongue to conform to the user's foot would be considerably reduced. In the longitudinal direction of the shoe, the seam or seams should not be placed closer to the forward edge of the foot opening than 2 cm and preferably not closer than 4 cm, but yet run along the central line for at least half the upper length from the forward end of the slit in the direction toward the front edge of the foot opening.

In the drawing, the fastening of the tongue is shown in the preferred embodiment by which the tongue, in addition to being fastened by a longitudinal seam 11, is fastened to the upper with at least one seam 13 running transversely over at least between one-third and two-thirds, and preferably about half, of the periphery of the upper, from the central line, as seen in a cross section, and in front of the slit's forward end 12. On the other hand, it has been experienced that it is disadvantageous to fasten the tongue transversely on the opposite side as well.

Due to the way in which the tongue is fastened to the upper, the lower and upper sections of the tongue are allowed to move inside the shoe, under the upper, so that the tongue can adapt flexibly to feet of different shapes, without the necessary stability being lost, or the tongue being deformed when the shoe twists and bends. The way the tongue is fastened to the upper makes possible the use of a tongue which is considerably larger than is possible—with a view to the use of the shoe in practice—with a conventional fastening of the tongue. This possibility means an important advantage because using a large tongue covering and surrounding most of the upper and side parts of the foot achieves a feeling of the shoe being custom-made for the user's foot, this in spite of the fact that it is well adaptable for users with extremely varying foot shapes.

The shape of a preferred tongue is shown in FIG. 2. This tongue is essentially heart-shaped and protrudes beyond the transverse seam 13 so that its forward part will extend free under the upper in the toe area, while its rear part **10*b* protrudes beyond the forward edge 4** outside the foot opening at least 0.5 cm and preferably about 1 cm. In the forward section the tongue should cover the toes, contributing to a feeling of a comfortable adjustment to the user's foot. With at least the same measures the tongue should, for the purpose of reducing pressures at the edge of the foot opening, extend beyond said edges at least as far backwardly as to the ankle portion of the opening's edge.

In connection with the central longitudinal fastening of the tongue to the upper as described, it has been found that an extremely good adaptation of the tongue to the foot, particularly when using thick or stiff leather, is obtained by manufacturing the tongue from two halves 21, which are substantially reversely equiform and sewn together along arc-shaped edges 22. When the halves are arranged in a plane as shown in the figure, symmetrically about a central line 20 constituting a chord of the arcs extending between forward 23 and rearward 24 ends of the edges, the arcs have each a height of between 0.3 and 0.6 cm.

For a shoe according to the invention an additional improvement in flexibility can be attained by a specific design of the side lace. This improvement is achieved by the lace slit 2, FIG. 1, at its forward edge 12 having a V-shaped recess 15 arranged at the end of the lace slit near the toe area, the two additional V-shaped recesses 16 and 17, being transverse to central line 6. The latter, together with optional additional recesses correspondingly arranged along the slit, are placed juxtaposed so that their open ends overlap over part of their length. Experiments have shown that these recesses should not have sharp points because this results in specific pressure lines or points; therefore these points should be rounded to achieve as even a pressure distribution as possible.

To cover the V-shaped recess 17 when the shoe is used by persons having high insteps, the tongue's outer edge **10*d* may advantageously have an arc-shaped portion 10*h*** with a maximum width of between 8 and 15 mm, measured from the adjacent tongue edge portions.

We claim:

1. A shoe, particularly a sport shoe, having a side lacing, extending substantially in the longitudinal direction of the shoe on the outside thereof beside, when seen from above, a longitudinal central line of the shoe, extending from the forward central portion of the foot opening to the foremost point of the toe area, said side lacing being formed by a slit extending from the edge of the foot opening in said direction toward the toe area at the outside of the shoe over a part of the shoe's upper, and a tongue covering from below the side lacing and portions of the upper above a user's foot, in which the tongue (10) is fastened to the upper (5) with a stitching (11) located within an area extending substantially about said central line (6) at a distance from and along said slit (2), and extending, as seen in the longitudinal direction of the shoe, from the forward end (12) of said slit toward the foot opening (3) over a distance of least one third of the slit's length.

2. Shoe according to claim 1, said stitching (11) ending, in the direction toward the foot opening (3), at a distance of at least 2 cm and preferably at least 4 cm from the forward edge (7) of the foot opening.

3. Shoe according to any one of the previous claims, said tongue (10) consisting of two flat portions (21) which are substantially reversedly equiform about a central line (20) of the tongue, edges (22) of said portions extending along said tongue central line being cut concavely in arcs, each having, relative to a chord between ends (23,24) of said edges (22), a height of between 0.3 and 0.6 cm, said portions (21) being joined together along said edges.

4. Shoe according to any one of the previous claims, said slit (2) having at its forward end (12) a substantially V-shaped recess (15) extending transversely in the direction toward said central line (6) and said stitching (11).

5. Shoe according to any one of the previous claims, said slit (2) in each one of its edges having at least one substantially V-shaped recess (16,17, resp.) located between the forward end (12) of the slit (2) and the foot opening (3).

* * * * *

UNITED STATES PATENT AND TRADEMARK OFFICE

CERTIFICATE OF CORRECTION

PATENT NO. : 4,517,753

DATED : May 21, 1985

INVENTOR(S) : Leslie Rosenbaum and Robert Alberts

It is certified that error appears in the above-identified patent and that said Letters Patent is hereby corrected as shown below:

Column 1, line 63, change "U.S. Pat. No. 3,299,542" to --US-PS 3,299,543--.

Column 2, line 43, change "edge 8 of the area" to--edge 8 of the toe area--.

Column 4, line 2, change "area, the two" to --area, and two--.

Signed and Sealed this

*Tenth* Day of *September 1985*

[SEAL]

*Attest:*

DONALD J. QUIGG

*Attesting Officer* *Acting Commissioner of Patents and Trademarks - Designate*